US010159614B2

(12) United States Patent
Sammons et al.

(10) Patent No.: US 10,159,614 B2
(45) Date of Patent: Dec. 25, 2018

(54) HOSPITAL BED

(71) Applicant: HUNTLEIGH TECHNOLOGY LIMITED, Dunstable (GB)

(72) Inventors: Alexander G. Sammons, San Antonio, TX (US); Kevin S. Wilson, San Antonio, TX (US)

(73) Assignee: Huntleigh Technology Limited (GB)

( * ) Notice: Subject to any disclaimer, the term of this patent is extended or adjusted under 35 U.S.C. 154(b) by 0 days.

(21) Appl. No.: 14/401,193

(22) PCT Filed: May 14, 2013

(86) PCT No.: PCT/IB2013/001575

§ 371 (c)(1),
(2) Date: Nov. 14, 2014

(87) PCT Pub. No.: WO2013/171587

PCT Pub. Date: Nov. 21, 2013

(65) Prior Publication Data

US 2015/0135439 A1 May 21, 2015

Related U.S. Application Data

(60) Provisional application No. 61/646,551, filed on May 14, 2012, provisional application No. 61/692,557, filed on Aug. 23, 2012.

(51) Int. Cl.

| | |
|---|---|
| ***A61G 7/012*** | (2006.01) |
| ***A61G 1/02*** | (2006.01) |
| ***A61G 7/018*** | (2006.01) |
| ***A61G 7/05*** | (2006.01) |
| *A61G 7/015* | (2006.01) |

(52) U.S. Cl.
CPC ..... *A61G 7/012* (2013.01); *A61G 1/0237* (2013.01); *A61G 7/018* (2013.01); *A61G 7/0513* (2016.11); *A61G 7/015* (2013.01); *A61G 2203/74* (2013.01)

(58) Field of Classification Search
CPC ..... A61G 7/05; A61G 7/012; A61G 7/018; A61G 7/015; A61G 2203/74; A61G 7/00; A61G 1/00; A61G 1/0237
See application file for complete search history.

(56) References Cited

U.S. PATENT DOCUMENTS

| | | | | |
|---|---|---|---|---|
| 4,722,114 A | | 2/1988 | Neumann | |
| 5,537,701 A | * | 7/1996 | Elliott | A47C 19/005 5/616 |
| 5,682,631 A | | 11/1997 | Weismiller et al. | |

(Continued)

FOREIGN PATENT DOCUMENTS

| | | | |
|---|---|---|---|
| AU | 5673980 | A | 9/1980 |
| DE | 202005016344 | U1 | 12/2005 |

(Continued)

OTHER PUBLICATIONS

International Search Report issued for corresponding International Patent Application No. PCT/IB2013/001575, dated Jan. 21, 2014, 3 pages.

*Primary Examiner* — Nicholas F Polito
*Assistant Examiner* — Amanda L Bailey
(74) *Attorney, Agent, or Firm* — The Webb Law Firm

(57) ABSTRACT

Patient-support systems and apparatuses for supporting patients, including for example hospital beds.

8 Claims, 15 Drawing Sheets

(56) References Cited

U.S. PATENT DOCUMENTS

| | | | | |
|---|---|---|---|---|
| 5,715,548 | A * | 2/1998 | Weismiller | A61G 7/00 5/611 |
| 6,363,552 | B1 * | 4/2002 | Hornbach | A61G 7/015 5/425 |
| 8,069,513 | B2 * | 12/2011 | Turner | A61G 1/04 5/613 |
| 2002/0178502 | A1 * | 12/2002 | Beasley | A61G 7/015 5/618 |
| 2004/0064891 | A1 * | 4/2004 | Horitani | A47C 20/08 5/618 |
| 2004/0133982 | A1 * | 7/2004 | Horitani | A47C 20/041 5/618 |
| 2006/0000021 | A1 * | 1/2006 | Hayes | A47C 20/08 5/618 |
| 2007/0180621 | A1 * | 8/2007 | Turner | A61G 1/04 5/618 |
| 2008/0148484 | A1 * | 6/2008 | Hornbach | A61G 7/018 5/601 |
| 2010/0011505 | A1 * | 1/2010 | Horitani | A61G 7/015 5/616 |

FOREIGN PATENT DOCUMENTS

| | | | |
|---|---|---|---|
| DE | 202011105053 | U1 | 10/2011 |
| GB | 2362566 | A | 11/2001 |
| NL | 1004666 | C2 | 6/1998 |

* cited by examiner

HOSPITAL BED

CROSS REFERENCE TO RELATED APPLICATION

This application is a U.S. national stage of International Application PCT/IB2013/001575, filed May 14, 2013, which claims priority to (1) U.S. Provisional Patent Application No. 61/646,551, filed May 14, 2012, and (2) U.S. Provisional Patent Application No. 61/692,557, filed Aug. 23, 2012, all of which are incorporated by reference in their entireties.

BACKGROUND

1. Field of the Invention

The present invention relates generally to beds and support surfaces, and, more particularly, but not by way of limitation, to beds used to support patients in a hospital.

2. Description of Related Art

Various apparatuses are known in the art for supporting patients. For example, some hospital and other beds include a mattress with a frame that is configured to raise and lower. Some such support apparatuses have a frame that can articulate and includes a back section, a seat section, and a leg section, each of which may be pivotable relative to one or more of the other sections.

SUMMARY

This disclosure includes embodiments of patient support apparatuses, control units, and methods.

Any embodiment of any of the present devices, apparatus, and systems cars consist of or consist essentially of—rather than comprise/include/contain/have—any of the described steps, elements, and/or features. Thus, in any of the claims, the term "consisting of" or "consisting essentially of" cars be substituted for any of the open-ended linking verbs recited above, in order to change the scope of a given claim from what it would otherwise he using the open-ended linking verb.

Details associated with the embodiments described above and others are presented below.

Certain embodiments include a patient support apparatus comprising: an upper frame; a base frame; and a lifting assembly coupled to the upper frame and the base frame, where the lifting assembly is configured to raise and lower the upper frame with respect to the base frame. In particular embodiments, the lifting assembly comprises: a pivot member rotatably coupled to the base frame; an actuation member rotatably coupled to the upper frame and to the pivot member; and an actuator coupled to the actuation member, where the actuator is configured to extend and configured to raise the upper frame with respect to the base frame and to contract and lower the upper frame with respect to the base frame.

Specific embodiments can further comprise a biasing member coupled to the actuation member. In certain embodiments, the upper frame is configured to nest within the base frame when the upper frame is in a lowermost position. In particular embodiments, the actuation member is configured to nest within the pivot member when the upper frame is in a lowermost position. In certain embodiments, the actuation member and the pivot member each comprise a cross member and a pair of extension members, and the extension members comprise an angled portion distal to the cross member.

In particular embodiments, the actuator is coupled to a pivot bar extending between the extension members of the pivot member. In specific embodiments, the actuator is directly coupled to a leverage member extending from the cross member of the actuation member. In certain embodiments, the pivot member comprises a central extension member engaged with a slot in the upper frame. In particular embodiments, the extension member traverses the slot when the upper frame is raised or lowered with respect to the base frame. In specific embodiments, the slot is approximately equidistant between a first end of the upper frame and a second end of the upper frame. In specific embodiments, the actuator is a linear electric actuator. In certain embodiments, the actuator is configured to rotate with respect to the actuation member. In particular embodiments, the lifting assembly comprises a head end lifting mechanism proximal to a first end of the patient support apparatus and a foot end lifting mechanism proximal to a second end of the patient support apparatus.

Specific embodiments also include a patient support apparatus comprising: an upper frame; a base frame; and a lifting mechanism coupled to the upper frame and the base frame. In certain embodiments, the lifting mechanism Is configured to move the upper frame with respect to the base frame through a range of motion from a lowermost position to an uppermost position. In particular embodiments, the lifting mechanism comprises: an actuator; and a biasing member, where the biasing member is configured to exert a force on the lifting mechanism throughout the range of motion. In specific embodiments, the biasing member is a pneumatic cylinder. In certain embodiments, the actuator and the biasing member are substantially parallel. In particular embodiments, the actuator and the biasing member are non-concentric.

In specific embodiments, the lifting mechanism comprises: a pivot member rotatably coupled to the base frame, and an actuation member rotatably coupled to the upper frame and to the pivot member. In particular embodiments, the actuation member comprises a first leverage member coupled to the actuator and a second leverage member coupled to the biasing member. In certain embodiments, the actuator is coupled to the actuation member, and the actuator is configured to extend and raise the upper frame with respect to the base frame and to contract and lower the upper frame with respect to the base frame.

Specific embodiments also include a base framem and a patient support platform supported above the base frame, where the patient support platform comprises a first portion and a second portion. In particular embodiments, the first portion has a first end distal from the second portion and a second end proximal to the second portion, and the first portion is configured to move such that the first end of the first portion is raised while the second end of the first portion moves away from the second portion. In certain embodiments, the first portion of the patient support platform is coupled to a dynamic pivot mechanism comprising a pivot member, a slide member and a fink member. In particular embodiments, the pivot member is coupled to a pivot arm that is pivotally coupled to the link member, and in specific embodiments, the link member is pivotally coupled to the slide member.

In certain embodiments, the base frame comprises a head end and a foot end, and the first portion of the patient support platform is proximal to the head end of the base frame and the second portion of the patient support platform is proximal to the foot end of the base frame. Particular embodiments further comprise an actuator configured to raise the first end of the first portion.

Certain embodiments include a patient support apparatus comprising a patient support platform comprising a first end and a second end, where the patient support platform comprises a first portion configured to pivot around a first pivot point, in specific embodiments, the first pivot point is configured to translate in a linear path away from the second end when the first portion is pivoted around the first pivot point. In particular embodiments, the pivot point is included in a dynamic pivot mechanism comprising a pivot member, a slide member and a link member. In certain embodiments, the pivot member is coupled to a pivot arm that is pivotally coupled to the link member. In specific embodiments, the link member is pivotally coupled to the slide member.

Particular embodiments include a patient support apparatus comprising: a base frame comprising a first end, a second end, a first side, and a second side; a first pair of caster wheels proximal to the first end of the base frame; and a second pair of caster wheels proximal to the second end of the base frame. Specific embodiments also include a first pedal proximal to the first end of the base frame, and a second pedal proximal to the first end of the base frame; where the first pedal and second pedal are coupled to an actuation mechanism. In particular embodiments, the actuation mechanism is configured to restrict pivoting of the second pair of caster wheels when the first pedal is depressed, and the actuation mechanism is configured to restrict rotation of the first and the second pair of caster wheels when the second pedal is depressed. In certain embodiments, the first and second pedal are centrally located between the first side of the base frame and the second side of the base frame, and in particular embodiments the actuation mechanism comprises: a first link extending across the first end of the base frame; a first rod extending along the first side of the base frame; and a second rod extending along fee second side of the base frame, where the first link is operatively coupled to the first rod and the second rod.

In specific embodiments, the actuation mechanism is configured to rotate the first and second rod when either the first pedal or the second pedal is depressed. Particular embodiments further comprise a third pedal, a fourth pedal, a fifth pedal, and a sixth pedal proximal to a second end of the base frame, where the third and fourth pedals are proximal to the first side of the base frame and the fifth and sixth pedals are proximal to the second, side of the base frame. In certain embodiments, depression of the first pedal causes the third pedal and the fifth pedal to be depressed. In particular embodiments, depression of the first pedal causes the third pedal and the fifth pedal to be depressed and causes the second, fourth and sixth pedals to raise. In specific embodiments, depression of the second pedal causes the fourth pedal and the sixth pedal to be depressed. In certain embodiments, depression of the second pedal causes the fourth pedal arid the sixth pedal to be depressed and causes the first, third, and fifth pedals to raise. In particular embodiments, the first actuation mechanism is configured to restrict pivoting of the second pair of caster wheels when the first pedal is depressed. In specific embodiments, the actuation mechanism is configured to restrict rotation and pivoting of the first and the second pair of caster wheels when the second pedal is depressed.

Certain embodiments include a patient support apparatus comprising: an upper frame; a base frame comprising a first longitudinal member, a second longitudinal member, and a first rod extending between the first and second longitudinal members; a first load measurement device; and a first lifting mechanism coupled to the upper frame and the base frame. In particular embodiments, the first lifting mechanism is configured to raise and lower the upper frame with respect to the base frame: the first lifting mechanism comprises a first pivot member configured to pivot around the first rod; and the first load measurement device is coupled to the first longitudinal member and the first rod.

Specific embodiments further comprise a second load measurement device coupled to the second longitudinal member and the first rod. Particular embodiments further comprise a second rod extending between the first and second longitudinal members, and a second lifting mechanism coupled to the upper frame and the base frame, in certain embodiments, the second lifting mechanism is configured to raise and lower the upper frame with respect to the base frame, and the second lifting mechanism comprises a second pivot member configured to pivot around the second rod. Particular embodiments comprise a third load measurement device coupled to the first longitudinal member and the second rod, and a fourth load measurement device coupled to second longitudinal member and the second rod. In certain embodiments, the first load measurement device remains stationary when the upper frame is raised with respect to the lower frame. In specific embodiments, the first load measurement device is substantially contained within base frame. In particular embodiments, the first load measurement device is positioned at positioned at an angle of approximately 20 degrees from horizontal. In certain embodiments, the base frame is supported, by a plurality of caster wheels and wherein the first load measurement device is located at a height below the top of the plurality of caster wheels.

In certain embodiments, the first load measurement device comprises: a body having a first portion, a second portion, a first opening in the second portion configured to receive a portion of the first rod, and a second opening in the second portion between the first opening and the first portion; and a plurality of sensors disposed in the second opening; wherein the first portion has a first longitudinal axis and the second portion has a second longitudinal axis disposed at a non-parallel angle relative to the first longitudinal axis. In certain embodiments, the second longitudinal axis bisects each of the first opening and the second opening. In certain embodiments, the body of the first load measurement device includes a transition portion between first portion and the second portion, and the second portion has a substantially constant outer cross-sectional perimeter between the transition portion and a point on an opposite side of the first opening relative to the first portion, in certain embodiments, the second longitudinal axis is centered in the substantially outer cross-sectional perimeter. In certain embodiments, the body of the first load measurement device includes an interior surface defining the second opening, and the plurality of sensors are in contact with the interior surface. In certain embodiments, the body of the first load measurement device is configured to be coupled to the base frame such that the second longitudinal axis of the second portion is substantially parallel to the first and second longitudinal members of the base frame. In certain embodiments, the body of the load measurement device is configured to be coupled to the base frame such that the second longitudinal axis of the second portion is substantially horizontal, in certain embodiments. the body of the first load measurement device is configured to be coupled to the base frame such that if the patient support apparatus is supported by a horizontal surface, the second longitudinal axis of the second portion is substantially parallel to the horizontal surface. In certain embodiments, a second load measurement device is substantially similar to the first load measurement device. In certain embodiments, each of second, third, and fourth load measurement devices is substantially similar to the first load measurement device.

Certain embodiments include a load measurement device comprising: a body having a first portion, a second portion, a first opening in the second portion configured to be coupled to a load, and a second opening in the second portion between the first opening and the first portion; a plurality of sensors disposed in the second opening; wherein the first portion has a first longitudinal axis and the second portion has a second longitudinal axis disposed at a non-parallel angle relative to the first longitudinal axis; and where the first portion is configured to be coupled to a supporting structure such that the second longitudinal axis of the second portion is substantially horizontal. Specific embodiments further comprise: a plurality of sensors disposed in the second opening. In certain embodiments, the body includes an interior surface defining the second opening, and the plurality of sensors are in contact with the interior surface. In certain embodiments, the second longitudinal axis bisects each of the first opening and the second opening. In certain embodiments, the body of the first load measurement device includes a transition portion between first portion and the second portion, and the second portion has a substantially constant outer cross-sectional perimeter between the transition portion and a point on an opposite side of the first opening relative to the first portion.

BRIEF DESCRIPTION OF THE DRAWINGS

The following drawings illustrate by way of example and not limitation. For the sake of brevity and clarity, every feature of a given structure is not always labeled in every figure in which that structure appears. Identical reference numbers do not necessarily indicate an identical structure. Rather, the same reference number may be used, to indicate a similar feature or a feature with similar functionality, as may non-identical reference numbers. The figures are drawn to scale (unless otherwise noted), meaning the sizes of the depicted elements are accurate relative to each other for at least the embodiment depicted in the figures.

DESCRIPTION OF ILLUSTRATIVE EMBODIMENTS

Figure 1:
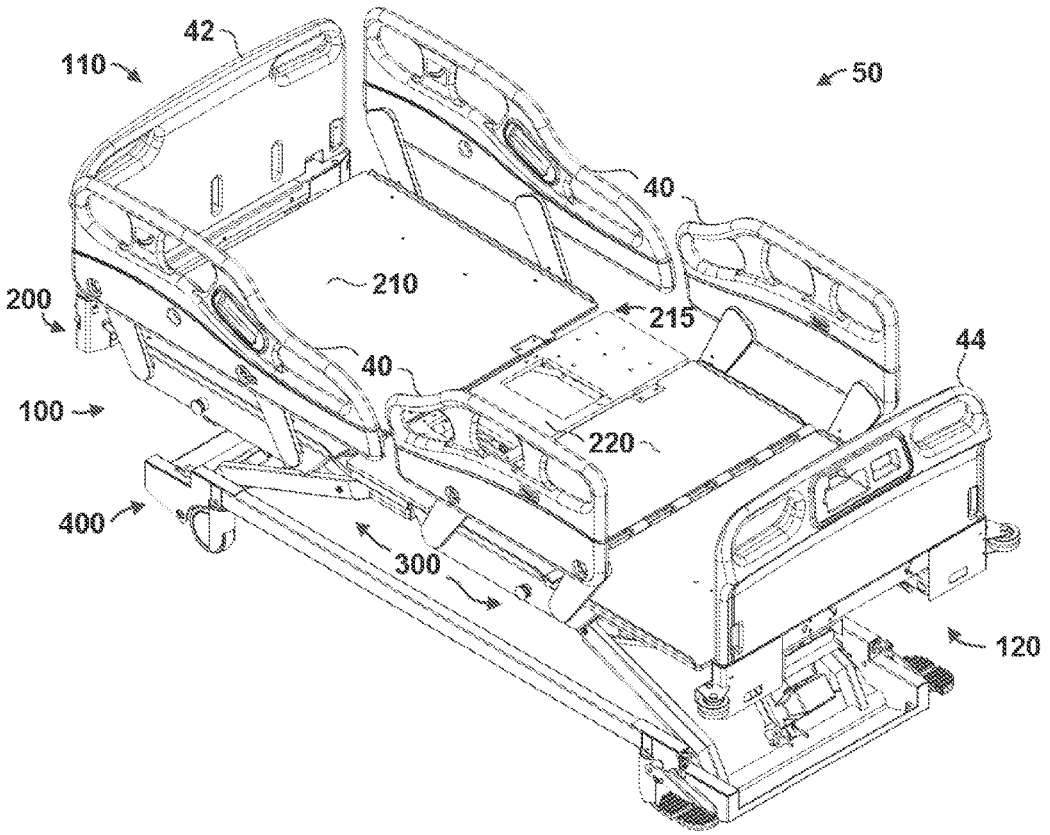
FIG. 1 depicts a perspective view of an example of a patient support bed comprising an exemplary embodiment of a patient support apparatus.
Figure 2:
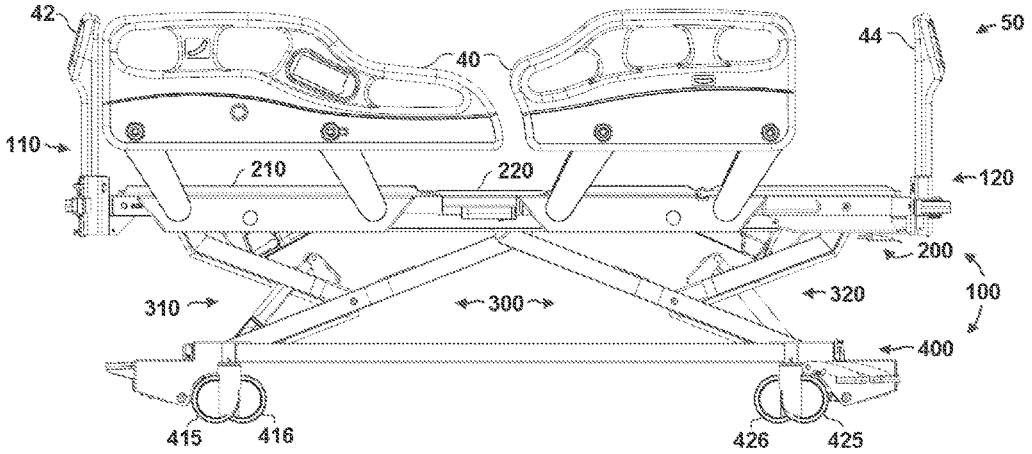
FIG. 2 depicts a side view of the patient support bed of FIG. 1.
Figure 3:
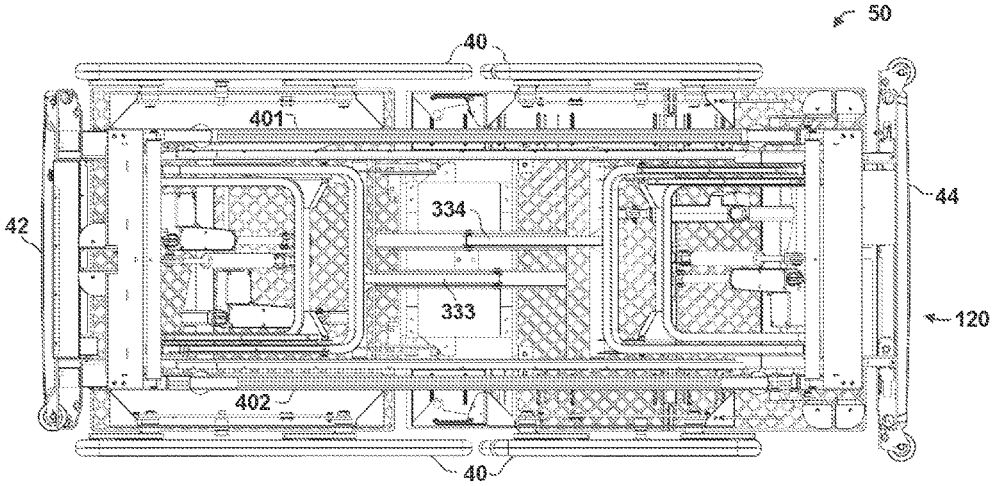
FIG. 3 depicts a bottom view of the patient support bed of FIG. 1.
Figure 4:
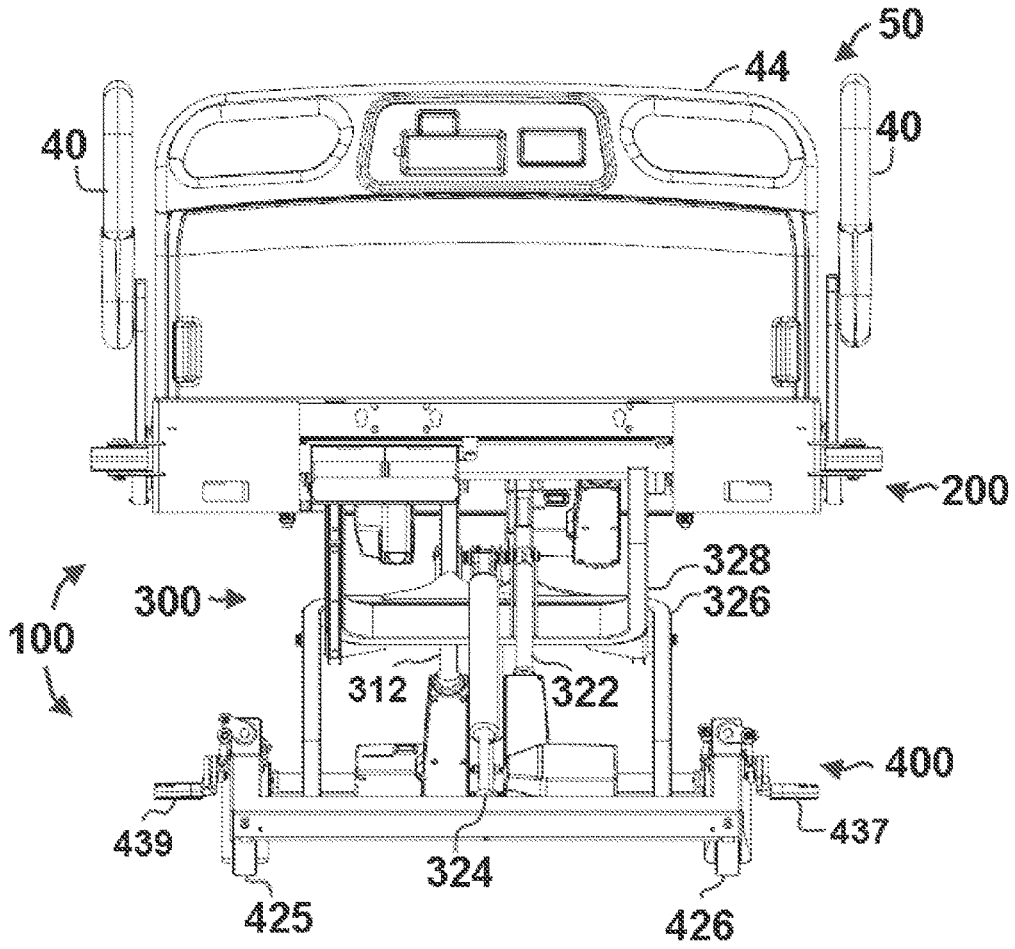
FIG. 4 depicts an end view of the patient support bed of FIG. 1.

The term "coupled" is defined as connected, although not necessarily directly, and not necessarily mechanically; two items that are "coupled" may be unitary with each other. The terms "a" and "an" are defined as one or more unless this disclosure explicitly requires otherwise. The term "substantially" is defined as largely but not necessarily wholly what is specified (and includes what is specified; e.g., substantially 90 degrees includes 90 degrees and substantially parallel includes parallel), as understood by a person of ordinary skill the art. In any disclosed embodiment, the terms "substantially," "approximately," and "about" may be substituted with "within [a percentage] of" what is specified, where the percentage includes 0.1, 1, 5, and 10 percent.

The terms "comprise" (and any form of comprise, such as "comprises" and "comprising"), "have" (and any form of have, such as "has" and "having"), "include" (and any form of include, such as "includes" and "including") and "contain" (and any form of contain, such as "contains" and "containing") are open-ended linking verbs. As a result, a device or kit that "comprises," "has," "includes" or "contains" one or more elements possesses those one or more elements, but is not limited to possessing only those elements. Likewise, a method that "comprises," "has," "includes" or "contains" one or more steps possesses those one or more steps, but is not limited to possessing only those one or more steps.

Further, a device, apparatus or system that is configured in a certain way is configured in at least that way, but it can also be configured in other ways than those specifically described.

Referring now to the drawings, and more particularly to FIGS. 1-6, shown therein and designated by the reference numeral 50 is a patient support bed with which the present features may be implemented individually or in any suitable combination. In the embodiment shown, patient support bed 50 comprises a frame or support apparatus 100 having a head end 110 and a foot end 120. Apparatus 100 further comprises an upper frame 200 and a base frame 400, as well as a lifting assembly 300 configured to raise and lower upper frame 200 relative to base frame 400. As explained in more detail below, lifting assembly 300 comprises a plurality of pivoting members and actuators configured to raise and lower upper frame 200. In the embodiment shown in FIGS. 1-3, patient support bed 50 comprises a patient support platform 215 comprising a first portion 210 proximal to head end 110 and a second portion 220 proximal to foot end 120. Patient support bed 50 also comprises a plurality of side guards 40, a head end guard 42, and a foot end guard 44.

Referring now to FIGS, 6-11, apparatus 100 is shown without patient support platform 215, side guards 40, head end guard 42 or foot end guard 44 for purposes of clarity in order to more easily view additional features and components of apparatus 100. It is understood that not all components are visible in all figures. In addition, not all components visible in the figures have been labeled for purposes of clarity.

As shown in the figures, apparatus 100 also comprises a pair of wheels 415, 416 located proximal to head end 110 and a pair of wheels 425, 426 located proximal to foot end 220. In exemplary embodiments, wheels 415, 416 and 425, 426 are configured as casters that can pivot (e.g., move around a vertical axis) as well as rotate (e.g. move around a horizontal axis). Base frame 400 also comprises a pair of longitudinal members 401, 402 and upper frame 200 comprises a pair of longitudinal members 201, 202.

Lifting assembly 300 further comprises a head end lifting mechanism 310 and a toot end lifting mechanism 320, each coupled to upper frame 200 and base frame 400. In the embodiment shown, head end lifting mechanism 310 comprises a head end actuator 312 and a head end biasing member 314. Head end lifting mechanism 310 also comprises a pivot member 316 arid an actuation member 318 coupled to head end actuator 312 and head end biasing member 314. Similarly, foot end lifting mechanism 320 comprises a foot end actuator 322 and a foot end biasing member 324 coupled to a foot end pivot member 326 and a foot end actuation member 328.

Figure 10:
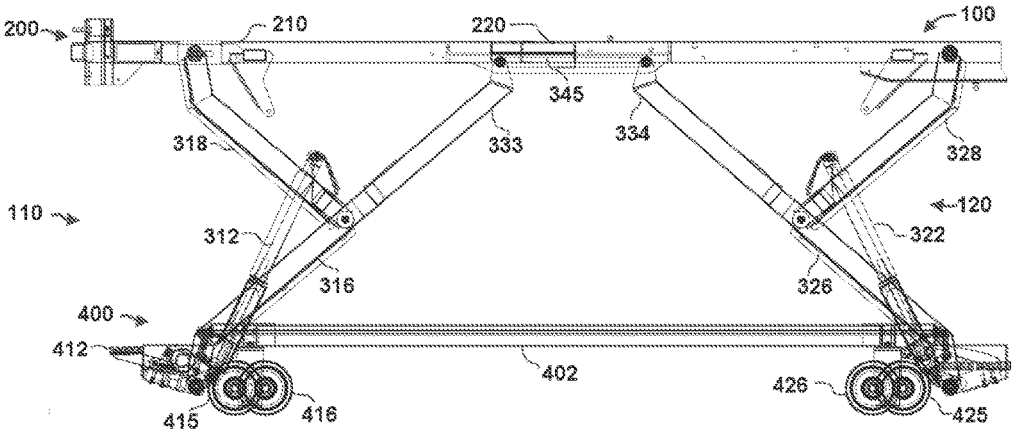
FIG. 10 depicts a side view of the patient support apparatus of FIG. 1 in an uppermost position.
Figure 11:
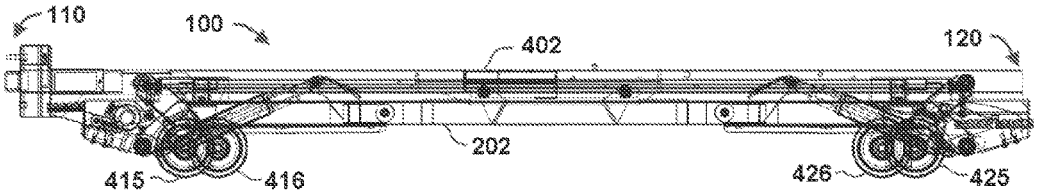
FIG. 11 depicts a side view of the patient support apparatus of FIG. 1 in an lowermost position.

During operation, head end lifting mechanism 310 and foot end lifting mechanism 320 can be operated to raise and lower upper frame 200 with respect to base frame 400 through a range of motion from a lowermost position (shown in FIG. 10) to an uppermost position (shown in FIG. 11). Specifically, actuators 312, 322 can be extended or retracted between pivot members 316, 326 and actuation members 318, 328, in the embodiment shown, biasing members 314, 324 are biased to extend in length to provide additional force to assist actuators 312, 322 in raising upper frame 200.

As actuators 312, 322 and biasing members 314, 324 extend in length, actuation members 318 and 328 are actuated to raise upper frame 200. In the embodiment shown, actuation members 318 and 328 are generally U-shaped and comprise a cross member 319 and 329, respectively. Actuation members 318 and 328 also comprise a pair of extension members 317 and 327 extending from the ends of cross members 319 and 329.

In this exemplary embodiment, actuators 312, 322 are coupled to leverage members 315 and 325, which extend from a central portion of cross members 319 and 329, respectively. Biasing members 314, 324 are similarly coupled to leverage members 351 and 361. In certain embodiments, biasing members 314, 324 can be configured as pneumatic cylinders. In particular embodiments, biasing members 314, 324 may be pneumatic cylinders that are compressed throughout the range of motion from the lowermost position to die uppermost position of upper frame 200, and exert a force on lifting mechanisms 310 and 320 throughout the range of motion. In other embodiments, biasing members 314, 324 may be arranged in other configurations, including for example, springs. In particular embodiments, biasing members 314, 324 may be arranged as coil springs. Furthermore, in particular embodiments, biasing members 314, 324 may be configured with a force progressivity, also known as a 'K-factor', such that the force exerted by actuators 312, 322 on lifting mechanisms 310, 320 remains more constant throughout the range of motion of the upper frame 200. In certain embodiments, because of changing lift angles, the force required to lift upper frame 200 can be different depending on where in the motion range upper frame 200 is located (e.g., a mechanical advantage curve). Biasing members 314, 324 can be configured with a progressivity rate that significantly reduces the range of forces seen throughout the lifting range, as seen by actuators 312 and 322.

Pivot member 316 comprises a pair of extension members 311 and a pivot bar (or rod) 313 that extends between the ends of the extension members 311 that are proximal to head end 110. Pivot member 316 also comprises a cross member 331 and a central extension member 333, Similarly, pivot member 326 comprises a pair of extension members 321 and a pivot bar (or rod) 323 that extends between the ends of the extension members 321 that are proximal to foot end 120. Pivot member 326 also comprises a cross member 332 and a central extension member 334.

During operation, head end lifting mechanism 310 and foot end lifting mechanism 320 can be operated to raise and lower upper frame 200. For the sake of clarity, the operation of foot end lifting mechanism 320 will be described. It is understood that equivalent components of head end lifting mechanism 310 will operate in a manner similar to those of foot end lifting mechanism 320. Lifting mechanisms 310 and 320 serve to raise upper frame 200 in conjunction with each other or independently to raise either end of upper frame 200, as described in more detail below.

If a user desires to raise an end of upper frame 200 proximal to foot end 120, actuator 322 can be actuated to extend in length. Biasing member 324 will also extend in length, as it is biased towards an extended length. As both actuator 322 and biasing member 324 extend in length, they exert a force on leverage members 325 and cause actuation member 328 to rotate about cross-member 329. Leverage members 325 also rotate as part of actuation member 328 and exert an upward force on a cross member 205 of upper frame 200, causing upper frame 200 proximal to foot end 120 to raise in relation to base frame 400.

During extension of actuator 322 and biasing member 324, pivot member 326 also pivots around pivot bar 323, which is coupled to base frame 400. As previously explained, when actuator 322 and biasing member 324 extend, upper frame 200 proximal to foot end 120 is raised.

Central extension member 334 (of pivot member 326) is engaged with a slot 346 in upper frame 200. As upper frame 200 is raised, slot 346 exerts an upward force on central extension member 334, causing pivot member 326 to rotate about pivot bar 323 and extension member 334 to traverse slot 346.

As upper frame 200 continues to raise in height, pivot member 326 continues to rotate around pivot bar 323, and actuation member 328 continues to rotate around cross-member 329. As described above, pivot member 326 and actuation member 328 of foot end lifting mechanism 320 engage in a scissor-like action during the raising and lowering of upper frame 200 and the actuation of foot end lifting mechanism 320 can elevate upper frame 200 proximal to foot end 120 in a stable manner.

Bead end lifting mechanism 310 operates m a manner equivalent to toot end lifting mechanism 320 to raise upper frame 200 with respect to base frame 400. Head end lifting mechanism 310 can be activated with foot end lifting mechanism 320 if a user desires to maintain upper frame 200 in a generally level position during elevation (e.g., parallel to base frame 400 and the supporting floor surface). During activation of head end lifting mechanism 310, actuator 312 and biasing member 314 can be extended to actuate pivot member 316 and actuation member 318. Slot 345 of head end lifting mechanism 310 can similarly exert an upward force on central extension member 333, causing pivot member 316 to rotate about pivot bar 313 and extension member 333 to traverse slot 345.

Accordingly, head end lifting mechanism 310 and foot end lifting mechanism 320 can be operated so that upper frame 200 remains generally parallel to base frame 400. In addition, head end lifting mechanism 310 and foot end lifting mechanism 320 can be operated independently so that head end 110 is lowered or raised in comparison to the foot end 120 (e.g. in a Trendelenburg or reverse-Trendelenburg position).

In exemplary embodiments, apparatus 100 can comprise a control system to control the extension of actuators 312 and 322 to raise and lower upper frame 200. The control system can be used to raise and lower upper frame 200 in a substantially level manner (e.g. maintaining bead end 110 and foot end 120 at generally the same height from base frame 400 during the raising and lowering process) or to raise upper frame 200 in a Trendelenburg or reverse-Trendelenburg position.

As shown and described herein, in this embodiment lifting assembly 300 is configured to move upper frame 200 with respect to base frame 400 through a range of motion from a lowermost position shown in FIG. 11 to an uppermost position shown in FIG. 10. Lifting assembly 300 is configured such that biasing members 314 and 324 exert a force on the lifting assembly 300 throughout the range of motion of upper frame 200. In the illustrated embodiment, biasing members 314 and 324 are not concentric with, but are substantially parallel with actuators 312 and 322. In certain embodiments, biasing members 314 and 324 are parallel within five degrees with actuators 312 and 322. This arrangement can allow lifting biasing members 314 and 324 to assist actuators 312 and 322 in raising upper frame 200 with respect to base frame 400 throughout the range of motion of upper frame 200.

Figure 9:
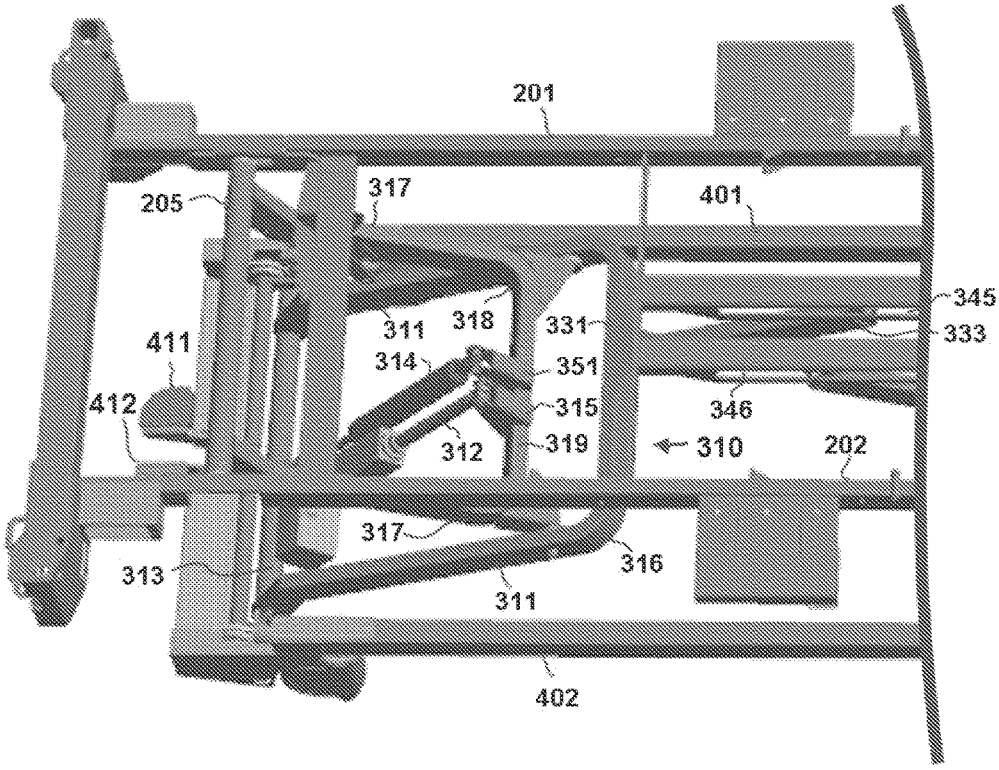
FIG. 9 depicts a view of a head end lifting mechanism of the patient support apparatus of FIG. 1.
Figure 12:
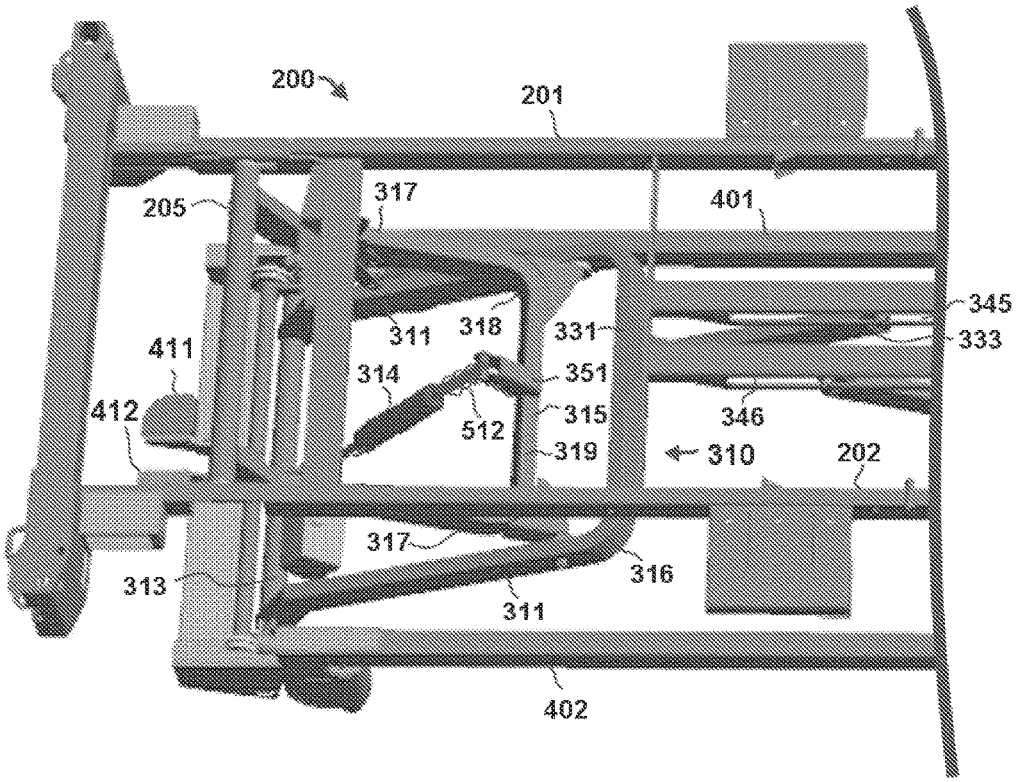
FIG. 12 depicts a view of a head end lifting mechanism of a patient support with a biasing mechanism that is concentric with an actuator.

In other embodiments, the biasing members may be concentric with actuators 312 and 322. For example, referring now to FIG. 12, a head end of a lifting mechanism is shown similar to that of FIG. 9. Reference numbers in FIG. 12 that are equivalent to those shown in FIG. 9 refer to components that are equivalent to those of FIG. 9. In this embodiment, however, biasing mechanism 512 is concentric with actuator 314. In this embodiment, biasing mechanism 512 is configured as a coil spring that is biased to expand in length along the primary axis of actuator 314. During operation, biasing member 512 can exert a force on leverage member 351 that assists in actuating actuation member 318 and raising upper frame 200.

The geometry and arrangement of components in head end lifting mechanism 310 and foot end lifting mechanism 320 provide numerous benefits and advantages. For example, the ability of actuation member 328 to rotate within pivot member 326 allows extension members 327 to nest within extension members 321 as upper frame 200 is lowered. In addition, extension members 321 comprise an angled portion 309 proximal to pivot bar 313, and extension members 327 comprise an angled portion 308 proximal to cross member 205, As actuation member 328 nests within pivot member 326, angled portions 308 and 309 allow for a maximum reduction in the height of foot end lifting mechanism 320.

As shown in the figures, actuators 312 and 322 both contract and rotate (with respect to pivot bars 313 and 323, respectively) as upper frame 200 is lowered. Actuators 312 and 322 are pivotally coupled to pivot bars 313 and 323 (via brackets extending from pivot bars 313 and 323), as well as leverage members 315 and 325. This configuration, along with other features described below, allows upper frame 200 to be lowered to a minimal height with respect to base frame 400. The geometry and arrangement of components in lifting assembly 300 allow upper frame 200 to rest at the same level as base frame 400 when upper frame 200 is in its lowermost position shown in FIG. 11. Specifically, longitudinal members 201 and 202 of upper frame 200 are at the same level as longitudinal members 401 and 402 of base frame 400.

Additional features of apparatus 100 further also allow for upper frame 200 to be lowered to a height below lower frame 400 as shown in FIG. 11. For example, apparatus 100 comprises load cells (e.g., devices configured to measure the amount of weight placed on a patient support surface) that are substantially contained within base frame 400. In other patient support surfaces, it is typical for load cells to extend between the base frame 400 and another component, e.g. an intermediate frame between the base frame and the upper frame. Such a configuration can affect the minimum height of the support apparatus when the upper frame is in the lowermost position.

Figure 13A:
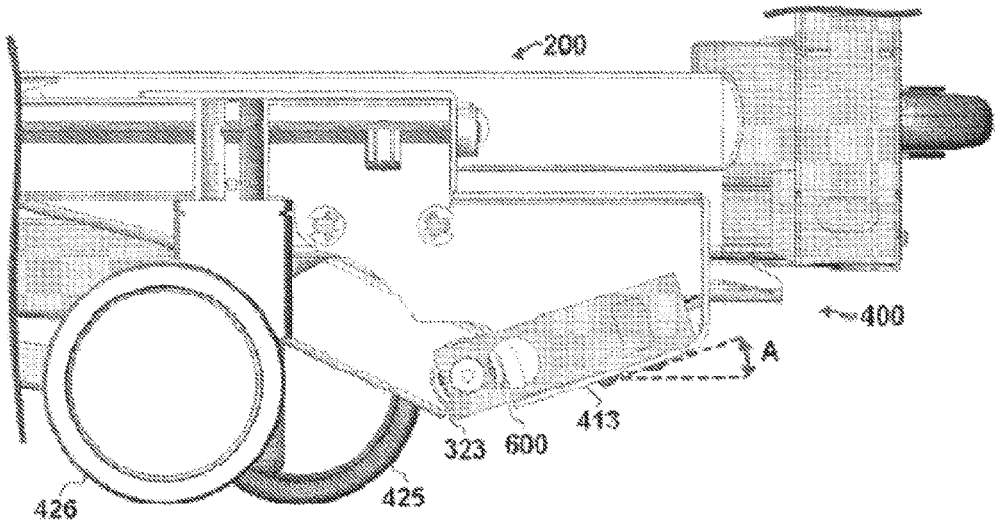
FIG. 13A depicts a section view illustrating a mounting of a load measurement device of the patient support apparatus of FIG. 1.

Referring now to FIG. 13A, a section view of the foot end of base frame 400 reveals a load measurement device 600 is substantially contained within base frame 400. Load measurement device 600 is coupled to pivot bar 323 and a lower plate 413 of longitudinal member 402 of base frame 400. In certain embodiments, load measurement device 600 can be configured as a load cell (e.g., a transducer that is used to convert a force into electrical signal).

Figure 6:
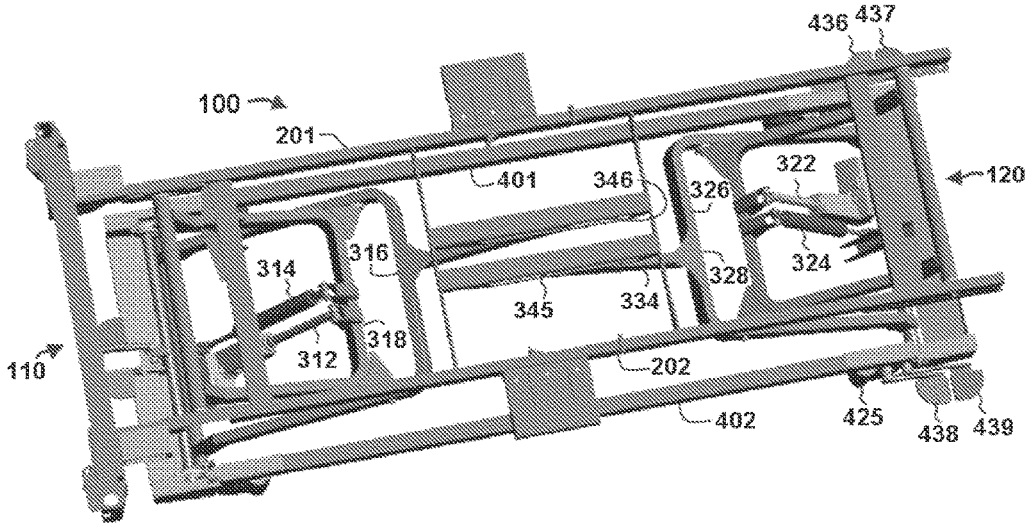
FIG. 6 depicts a first perspective view of the patient support apparatus of FIG. 1.
Figure 7:
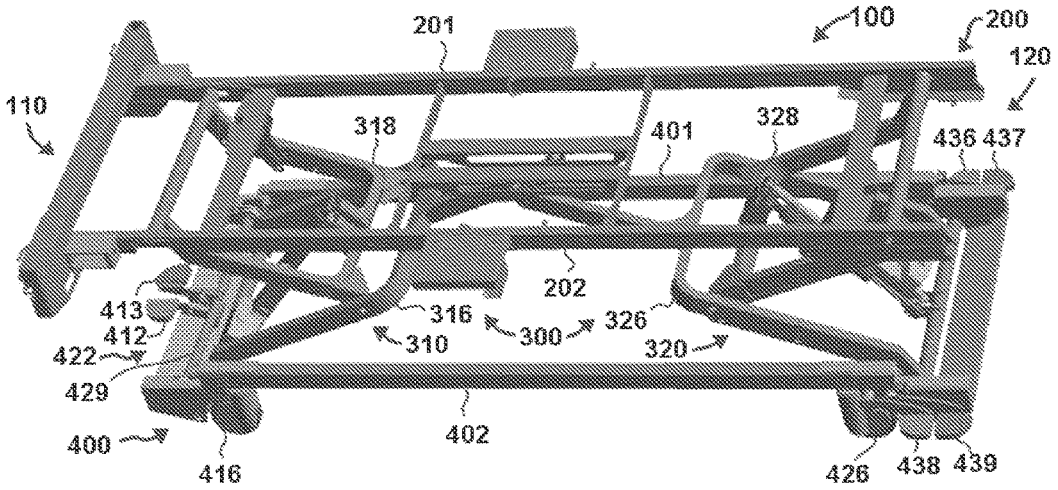
FIG. 7 depicts a second perspective view of the patient support apparatus of FIG. 1.
Figure 8:
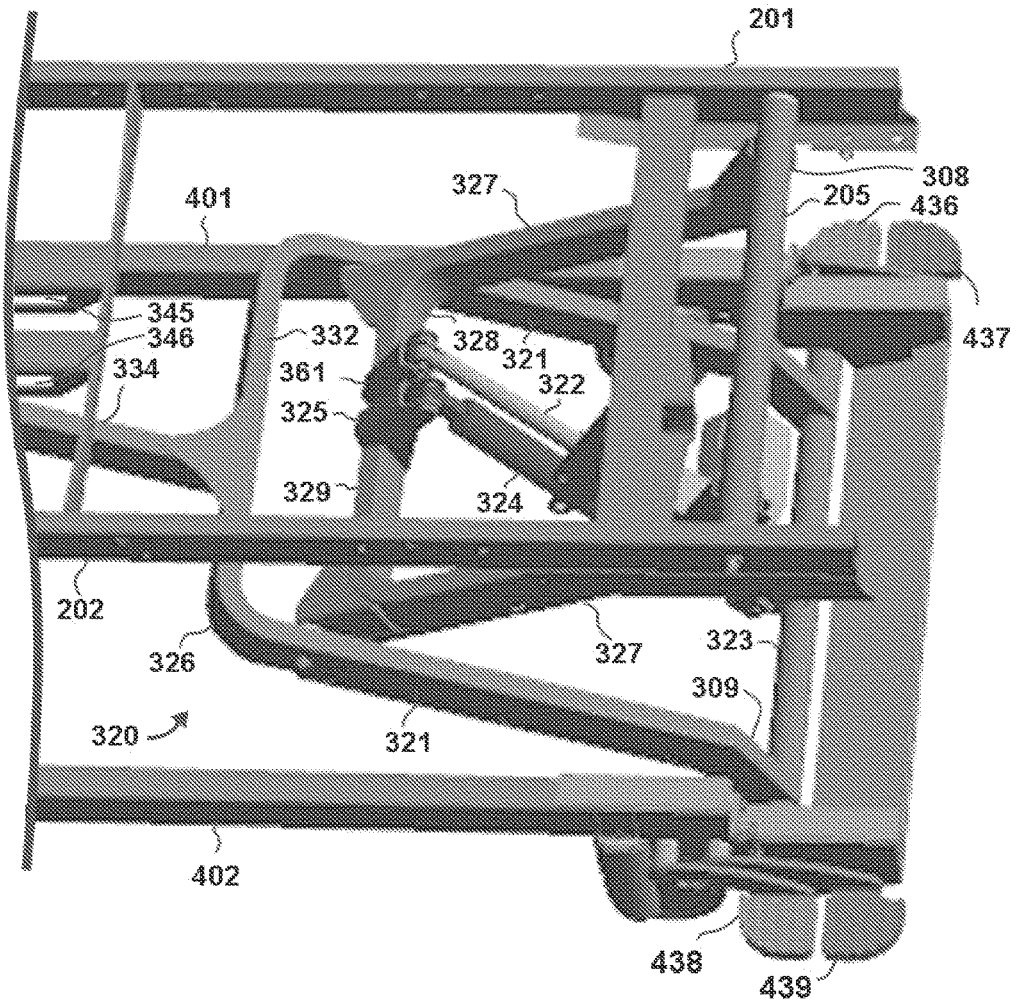
FIG. 8 depicts a view of a loot end lifting mechanism of the patient support apparatus of FIG. 1.

Forces can be transmitted from upper frame 200 to load measurement device 600 (e.g. through cross member 205, actuation member 318, leverage member 315, actuator 312 and pivot bar 313 shown in FIGS. 6-8). This transmission of forces from upper frame 200 to load measurement device 600 cart allow loads placed on upper frame 200 (e.g., including a patient resting on patient support platform 215) to be sensed and/or measured by load measurement device 600. As shown in FIG. 13A, pivot bar 323 is below the top of wheels 425 and 426. This mounting location allows load measurement device 600 to be placed in a position where it will not restrict the downward movement of upper frame 200. While only one load measurement device 600 is shown in the figures, it is understood that patient support apparatus 100 may comprise multiple load measurement devices. In certain exemplary embodiments, patient support apparatus 100 may comprise a load measurement device at each end of longitudinal members 401 and 402, for a total of four load measurement devices.

In the embodiment shown, load measurement device 600 is positioned at an angle A that is approximately 18 degrees from horizontal. Such a position can allow patient support apparatus 100 to approach ramps and inclined surfaces, and also allow load measurement device 600 to effectively measure the forces transmitted from pivot bar 313 to lower plate 413.

Figure 13B:
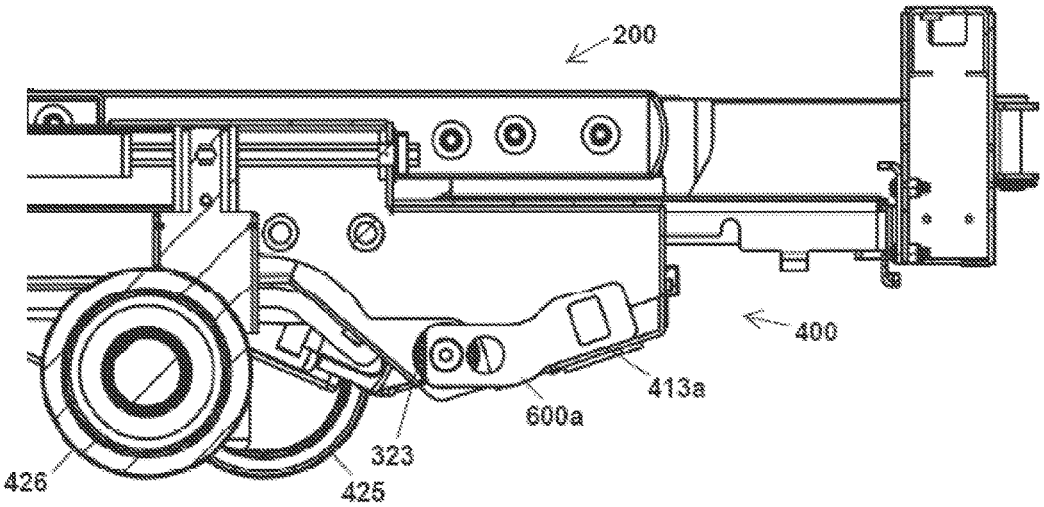
FIG. 13B depicts a section view illustrating a mounting of a second embodiment of a load measurement device of the patient support apparatus of FIG. 1.
Figure 13C:
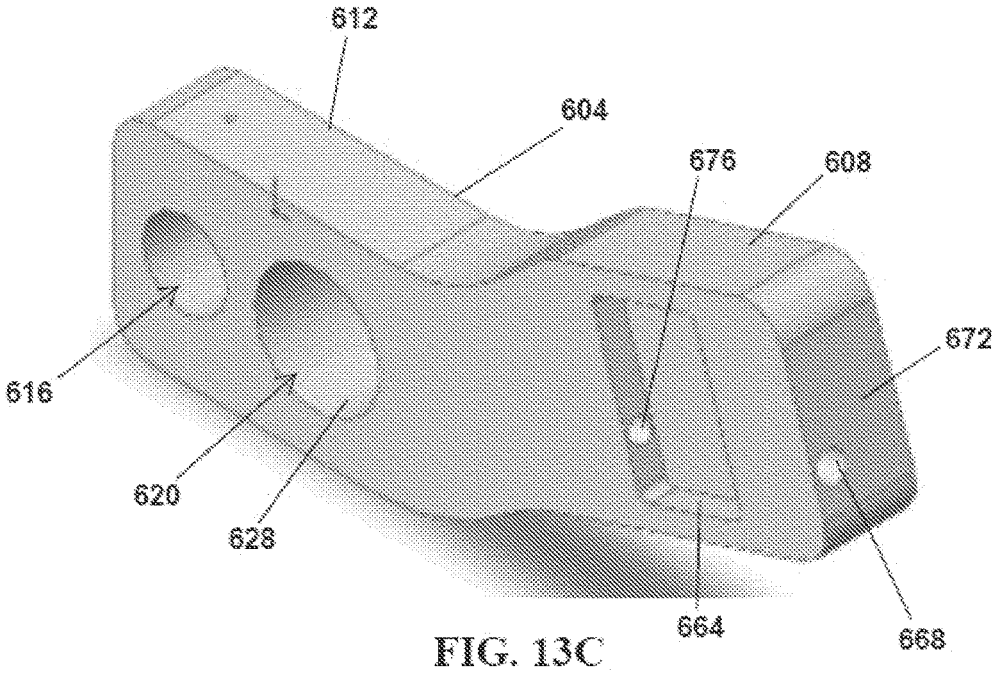
FIG. 13C depicts a perspective view illustrating a body of the load measurement device of FIG. 13B.
Figure 13D:
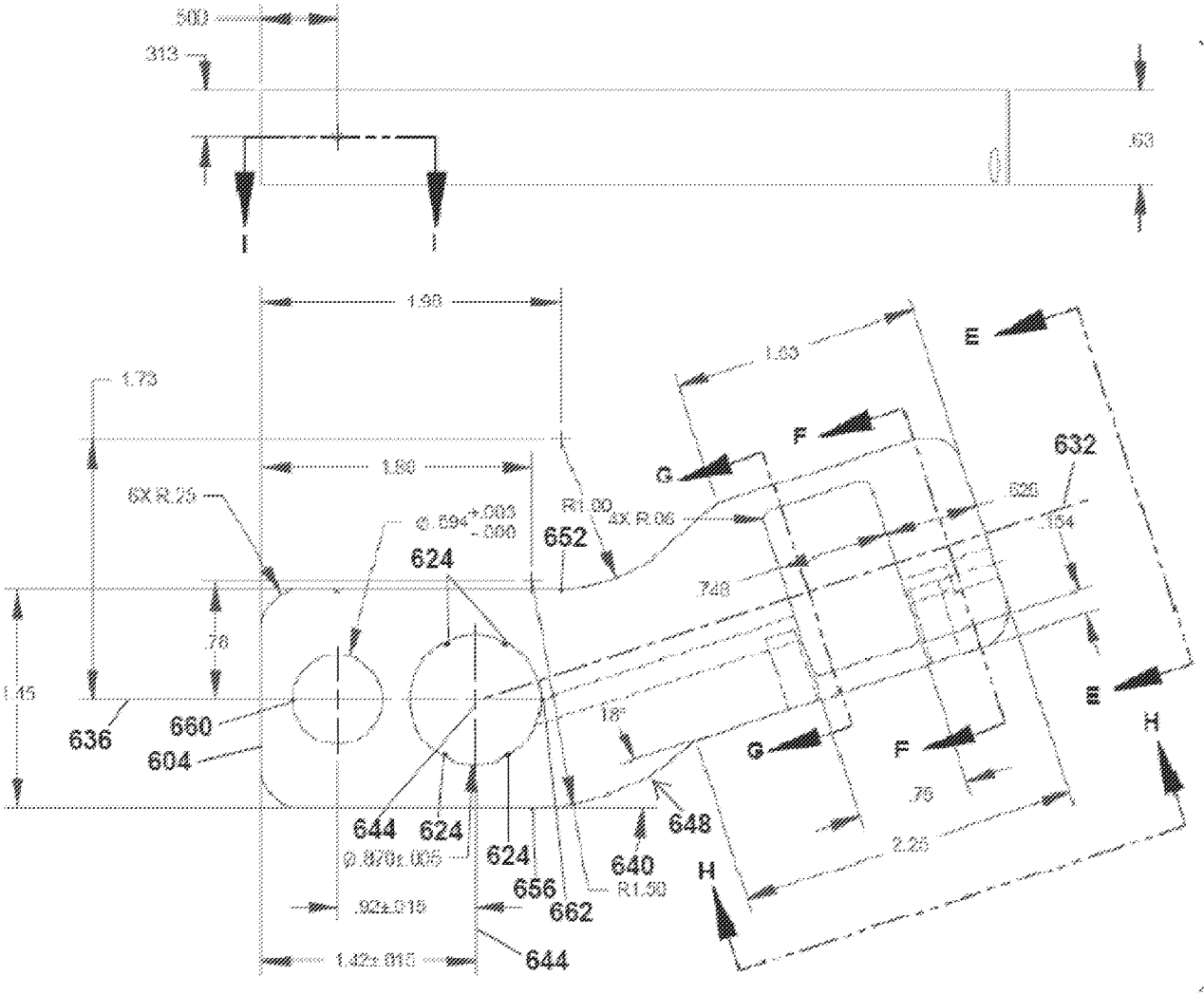
FIG. 13D depicts side and top views of the body of the load measurement device of FIG. 13B.
Figure 13E:
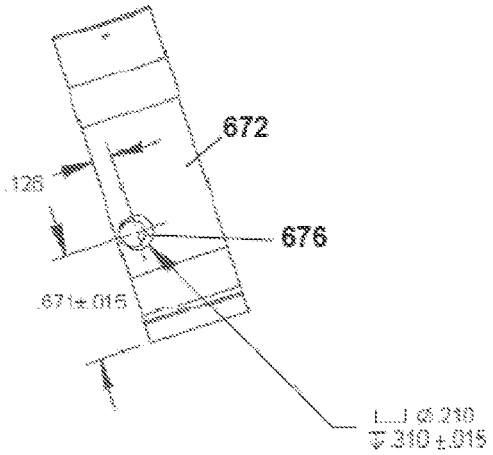
FIG. 13E depicts an end view of the body of FIGS. 13C-13D, viewed from the line E-E of FIG. 13D.
Figure 13F:
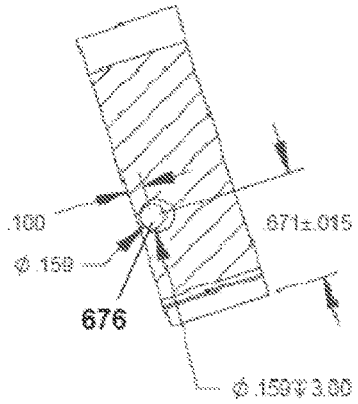
FIG. 13F depicts a section view of the body of FIGS. 13C-13D, taken along die line F-F of FIG. 13D.
Figure 13G:
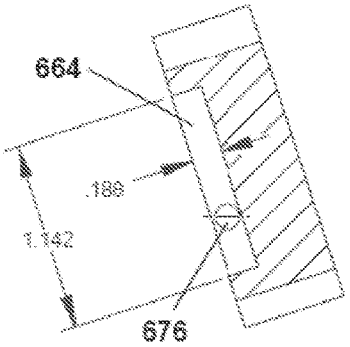
FIG. 13G depicts a section view of the body of FIGS. 13C-13D, taken along the line G-G of FIG. 13D.
Figure 13H:
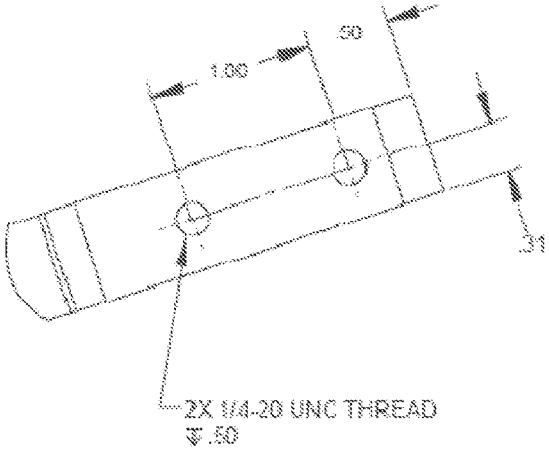
FIG. 13H depicts a bottom view of the body of FIGS. 13C-13D, viewed from the line II-II of FIG. 13D.
Figure 13I:
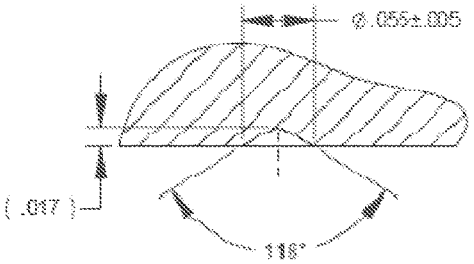
FIG. 13I depicts a partial section view of the body of FIGS. 13C-13D, taken along the line 1-1 of FIG. 13D.

Referring now to FIGS. 13B-13I, a second embodiment 600*a* of the present load measurement devices is shown, and may be similar in some respects to load measurement device 600. In certain embodiments, such as the one shown, load measurement device 600*a* can be configured as a load cell. FIG. 13B shows a section view of the foot end of base frame 400 with a load measurement device 600*a* substantially contained, within base frame 400. As with load measurement device 600 of in FIG. 13A, load measurement device 600*a* is coupled to pivot bar 323 and a lower plate 413*a* of longitudinal member 402 of base frame 400. FIG. 13C depicts a perspective view illustrating a body 604 of load measurement device 600*a;* FIG. 13I) depicts side and top views of body 604; FIG. 13E depicts an end view of body 604, viewed from the line E-E of FIG. 13D; FIG. 13F depicts a section view of body 604, taken along the line F-F of FIG. 13D; FIG. 13G depicts a section view of body 604, taken along die line G-G of FIG. 13D; FIG. 13H depicts a bottom view of body 604, viewed from the line H-H of FIG. 13D; and FIG. 13I depicts a partial section view of body 604, taken along the line I-I of FIG. 13D, FIGS. 13D-13I include non-limiting examples of certain dimensions (in inches) for at least some embodiments of the present load measurement devices 600*a*.

In the embodiment shown, body 604 has a first portion 608, a second portion 612, a first opening 616 in the second portion and configured to receive a portion of pivot bar 323, and a second opening (or gauge hole or gauge opening) 620 in second portion 612 between first opening 616 and first portion 608, as shown. In the embodiment shown, load measurement device 600*a* further comprises a plurality of sensors 624 (e.g., strain gauges) disposed in second opening 620. For example, in the embodiment shown, body 604 includes an interior surface 628 defining the second opening, and the plurality of sensors 624 are in contact with the interior surface. As shown, first portion 608 has a first longitudinal axis 632 and second portion 612 has a second longitudinal axis 636 disposed at a non-parallel (e.g., and non-perpendicular) angle 640 relative to first longitudinal axis 636. For example, in the embodiment shown, angle 640 is approximately (e.g., exactly and/or substantially) equal to 18 degrees. In this embodiment, body 604 is configured to be coupled to base frame 400 such that second longitudinal axis 636 is substantially horizontal, and/or such that second longitudinal axis is substantially parallel to first and second longitudinal members 401 and 402 of the base frame (and/or, if the bed is supported on a horizontal surface, substantially parallel to the horizontal surface).

As shown, second longitudinal axis 636 bisects each of first opening 616 and second opening 620. In this embodiment, sensors 624 include two sensors 624 disposed above second longitudinal axis 636 and two sensors disposed below second longitudinal axis 636 (e.g., mirrored relative to the two sensors 624 that are disposed above second longitudinal axis 636). For example, in the embodiment shown, sensors 624 are disposed at approximately 11 o'clock, approximately 1 o'clock, approximately 5 o'clock, and approximately 7 o'clock (e.g., 30 degrees, 150 degrees, 210 degrees, and 330 degrees) around second opening 620. In other embodiments, load measurement device 600*a* can comprise any suitable number of sensors (e.g., two sensors) in any suitable configuration (e.g., one sensor disposed at 12 o'clock or 0 degrees and one sensor disposed at 6 o'clock or 180 degrees), in this way, pairs of sensors 624 are also mirrored (e.g., symmetrical) about a vertical axis 644 that bisects second opening 608. Sensors 624 can be coupled together via one or more electric wires and/or other types of electrical connections. For example, in the embodiment shown, the four sensors 624 are electrically connected with a circuit that includes a Wheatstone bridge. With the physical configuration shown, in which pairs of sensors 624 are mirrored about second longitudinal axis 636 and about vertical axis 644, and in which second portion 612 is horizontal and second longitudinal axis 636 bisects both of first opening 616 and second opening 620, any horizontal components of force applied to body 604 at first opening 616 are offset by opposing reactions in body 604 (and signal consequently produced, by sensors 624) such that load cell 600*a* outputs a signal indicative of only the vertical component of the load or force applied to body 604 at first opening 616.

In the embodiment shown, body 604 includes a transition portion 648 between first portion 608 and second portion 612. For example, in the embodiment shown, transition portion 648 meets second portion 612 at upper point 652 and at lower point 656. In some embodiments, such as the one shown, second portion 612 has a substantially constant outer cross-sectional (e.g., rectangular) perimeter between the transition portion and a point (e.g., 660) on an opposite side of first opening 616 relative to the transition portion. In this embodiment, second longitudinal axis 636 is centered in the substantially outer cross-sectional perimeter. In some embodiments, such as the one shown, second portion 612 has a substantially constant outer cross-sectional (e.g., rectangular) perimeter between a point (e.g., 662) of the perimeter of second opening 620 that is closest to first portion 608 and a point (e.g., 660) on an opposite side of first opening 616 relative to the second opening.

Body 604 can comprise any suitable material that permits load measurement device 600*a* to function as described (e.g., as a load ceil). For example, body 604 can comprise any suitable durable material that has properties such that the end of second portion 612 (e.g., the part of second portion 612 with first opening 616) can flex linearly and elastically around second opening 620 for expected (e.g., specified functional) loads during use (e.g., within expected weight ranges of patients using the bed or patient support). For example, in some embodiments, body 604 can comprise 2024 Aluminum, (e.g., with T53 heat treatment), 6061 Aluminum, or any other suitably durable material such as steel or the like.

In the embodiment shown, body 604 further includes a recess 664 that extends partly through first portion 608 and that can be used, for example, to receive one or more circuits and/or other electronic components. In this embodiment, body 604 further includes a first passage 668 extending between a first end 672 of first portion 608 and recess 664, and a second passage 676 extending between recess 664 and second, opening 620. In some embodiments, wires or other electrical conductors (not shown) extend from sensors 624 in second opening 620 to one or more circuits and/or other electrical components in recess 664 through passage 676, and/or wires or other electrical conductors extend from the one or more circuits and/or other electrical components in recess 664 to a connector (not shown) outside of body 604 through passage 668.

As noted above for load measurement device 600, forces can be transmitted from upper frame 200 to load, measurement device 600*a* (e.g. through cross member 205, actuation member 318, leverage member 315, actuator 312 and pivot bar 313 shown in FIGS. 6-8). This transmission of forces from upper frame 200 to load measurement device 600*a* cars allow loads placed on upper frame 200 (e.g., including a patient resting on patient support platform 215) to be sensed and/or measured by load measurement device 600*a*. As shown in FIG. 13B, pivot bar 323 is below the top of wheels 425 and 426. Tins mounting location allows load measurement device 600*a* to be placed in a position where it will not restrict the downward movement of upper frame 200. As also noted above for load measurement device 600, while only one load measurement device 600*a* is shown in FIG. 13B, it is understood that patient support apparatus 100 may comprise multiple load measurement devices 600*a* (e.g., that each may be substantially similar to load measurement device 600*a*). In certain exemplary embodiments, patient support apparatus 100 may comprise a load measurement device 600*a* at each end of longitudinal members 401 and 402, for a total of four load measurement devices 600*a*.

In the embodiment shown, due to the non-parallel relationship (angle 640) between first portion 608 and second portion 612, the clearance or distance between the bottom of wheels 425 and 426 (e.g., and the ground) can be increased. Such an angular configuration can allow patient support apparatus 100 to approach ramps and inclined surfaces, and also allow load measurement device 600*a* to effectively measure the forces transmitted from pivot bar 313 to lower plate 413*a*.

It is often desirable to minimize the height of upper frame 200 and patient support platform 215 from a supporting floor surface. For example during use, a mattress (not shown) will be typically be placed on top of patient support platform 215 and a patient will rest on the mattress. In certain embodiments, such mattresses can be quite thick (e.g. as measured from the portion of the mattress contacting the patient to patient support platform 215). For example, many therapeutic mattresses include inflatable cells that can be used to provide alternating pressure therapy to patients. This can significantly increase the height at which a patient is supported. It can therefore be desirable to minimize the height of a patient support apparatus 100 in order to provide a caregiver access to the patient during procedures, including for example patient transport or transfer.

The ability of upper frame 200 to be reduced to a minimal height (e.g., including a height level with base frame 400) can accordingly provide numerous benefits to a patient and caregiver. For example, the reduced height of patient support platform 215 can provide for easier ingress and egress for a patient. In addition, minimizing the distance from the floor to the patient can reduce the likelihood of injury to a patient if the patient should accidentally fail from the support apparatus. Furthermore, reducing the patient support height can reduce the likelihood of injury to a caregiver during transfer of a patient to or from the support apparatus.

Additional features of exemplary embodiments of patient support apparatus 100 can also provide benefits, including improved safety, to a user and patient. For example, referring back now to FIG. 7, apparatus 100 also comprises a first pedal 412 and a second pedal 413 proximal to a head end 410 of base frame 400. In this exemplary embodiment, apparatus 100 further comprises a first pair of pedals 436 and 437 and a second pair of pedals 438 and 439 proximal to a foot end 420 of base frame 400. First pair of pedals 436 and 437 are proximal to longitudinal member 401 and wheel 425 on a first side of base frame 400. Second pair of pedals 438 and 439 are proximal to a longitudinal member 402 and wheel 426 on a second side of base frame 400.

Pedals 412, 438 and 436 are coupled to an actuation mechanism 422, which is configured to restrict pivoting of the second pair of caster wheels 425 and 426 when any of pedals 412, 438 and 436 are depressed. Pedals 413, 437 and 439 are also coupled to a second actuation mechanism 424 configured to restrict pivoting and rotation of the first and second pair of caster wheels 415, 416, 425 and 426 when any of pedals 413, 437 and 439 are depressed. In certain embodiments, actuation mechanism 422 comprises a link extending across the head end of base frame 400 (e.g. within cross member 429 between first and second longitudinal members 401 and 402). Actuation mechanism 422 may also comprise a rod extending down each side of base frame (e.g. within longitudinal members 401, 402) that engages the caster wheels 425, 426 to activate the first and second actuation mechanisms. For example, the rod may be a rotatable hex rod that extends through a mating portion of a stem of a caster such as the one disclosed in U.S. Pat. No. 4,722,114. In a particular embodiment, the link extending across the head end may be coupled to the rotatable hex rods extending down the side of each base frame via rod end bearings, commonly referred to as helm joints or rose joints. In specific embodiments, the link and hex rods may have extensions or tabs (that extend generally perpendicular from their primary axes) that are coupled to the rod end bearings. In such a manner, rotation of the head end link (e.g., via pedals 412 or 413) can provide rotation of the hex rods.

In the illustrated embodiment, pedal 412 can be operated (e.g., depressed toward the floor) to activate actuation mechanism 422 to restrict pivoting of caster wheels 425, 426. In certain nomenclature, actuation mechanism 422 may be referred to as a "steer lock" mechanism. Actuation of any of pedals 412, 436 or 438 can activate first actuation mechanism 422 and restrict pivoting of wheels 425 and 426 that are proximal to a foot end of patient support apparatus 100.

Such a configuration can allow a caregiver to conveniently activate actuation mechanism 422 when the caregiver is near foot end 420 or centrally located at bead end 110 (e.g., approximately equidistant between longitudinal members 401 and 402). The central location of head end 110 is often where a caregiver will be located in order to transport a patient on apparatus 100. The placement of pedals 412 and 413 in such a location can allow a user to more easily operate the pedals when needed after transport of the patient is completed, or in the event that a user needs to unexpectedly operate a pedal during transport.

In the illustrated embodiment, pedal 413 can be operated (e.g., depressed toward the floor) to activate actuation mechanism 422 to restrict pivoting and rotation of the first and second pair of caster wheels 415, 416 and 425, 426. In certain nomenclature, first actuation mechanism 422 may be referred to as a "central brake" mechanism. Actuation of any of pedals 413, 437 or 439 can activate actuation mechanism 422 and restrict rotation and pivoting of the first and second pair of caster wheels 415, 416 and 425, 426. As in the location of pedals described above, the location of pedals 413, 437 or 439 can allow a caregiver to conveniently apply the brakes to caster wheels 415, 416 and 425, 426 when the caregiver is located proximal to foot end 120 or bead end 110. This can allow a caregiver to quickly activate either the central brake or steer lock if needed while transporting a patient supported by apparatus 100, The location of pedals 412, 413, 436, 437, 438 and 439 can therefore increase the safety of the patient and caregiver during transport. Depressing pedal 413 also causes pedals 437 and 439 to be depressed and raises pedals 412, 436 and 438. Likewise, depressing pedal 412 also causes pedals 436 and 438 to be depressed and raises pedals 413, 437 and 439.

Figure 5:
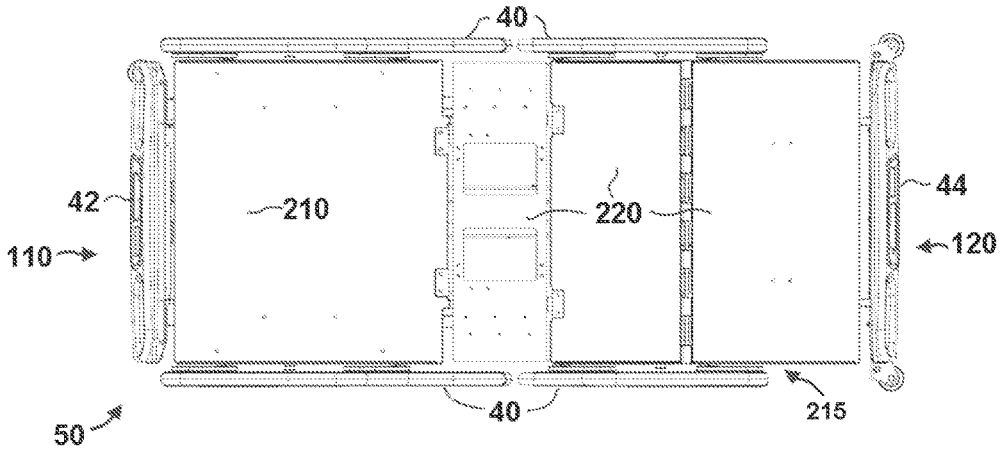
FIG. 5 depicts a top view of the patient support bed of FIG. 1.
Figure 14:
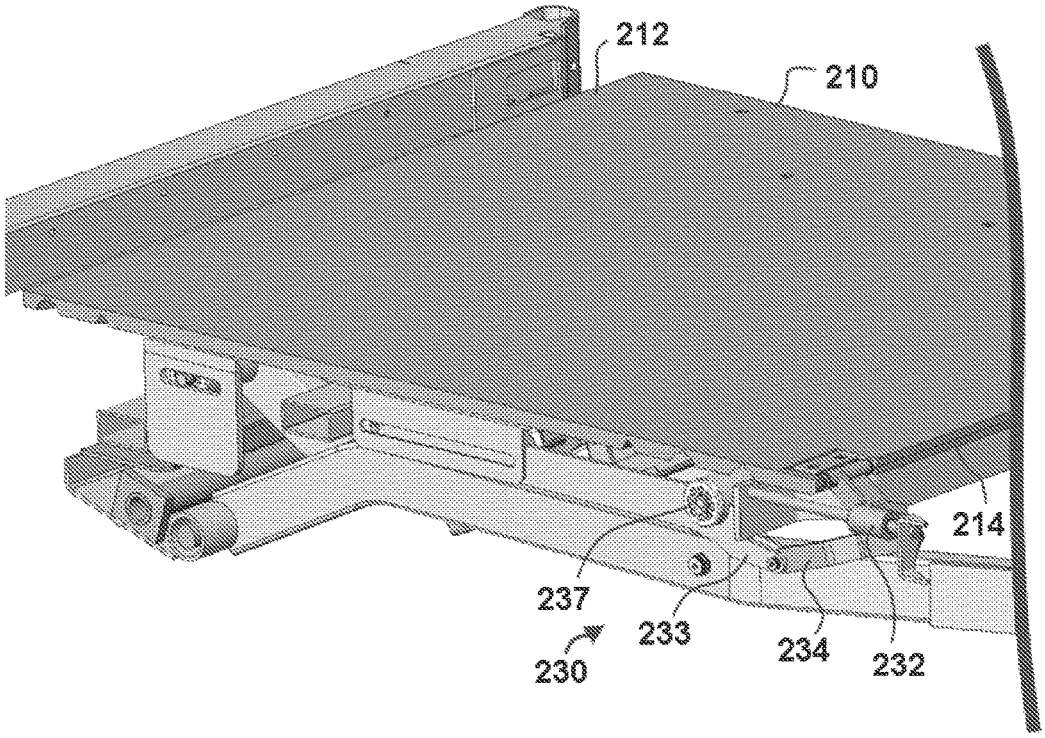
FIG. 14 depicts a perspective view of a pivoting mechanism of the patient support apparatus of FIG. 1 in a lowered position.
Figure 15:
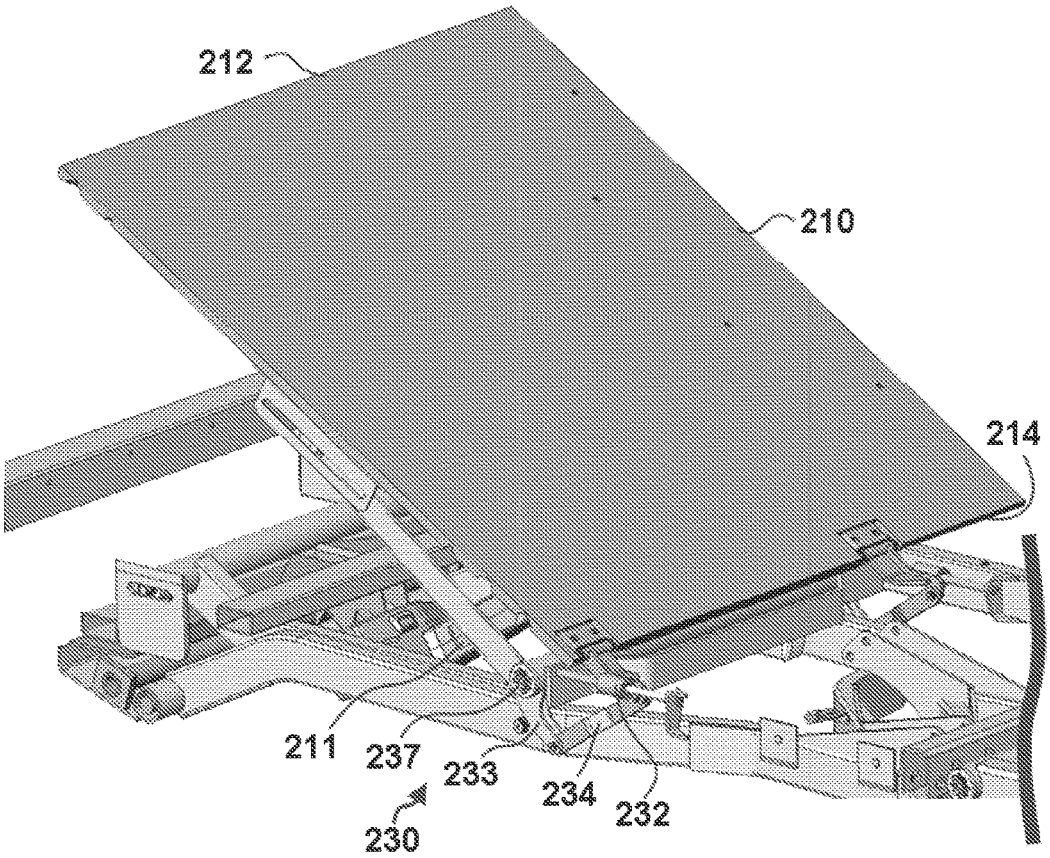
FIG. 15 depicts a perspective view of a pivoting mechanism of the patient support apparatus of FIG. 1 in a partially elevated position.
Figure 16:
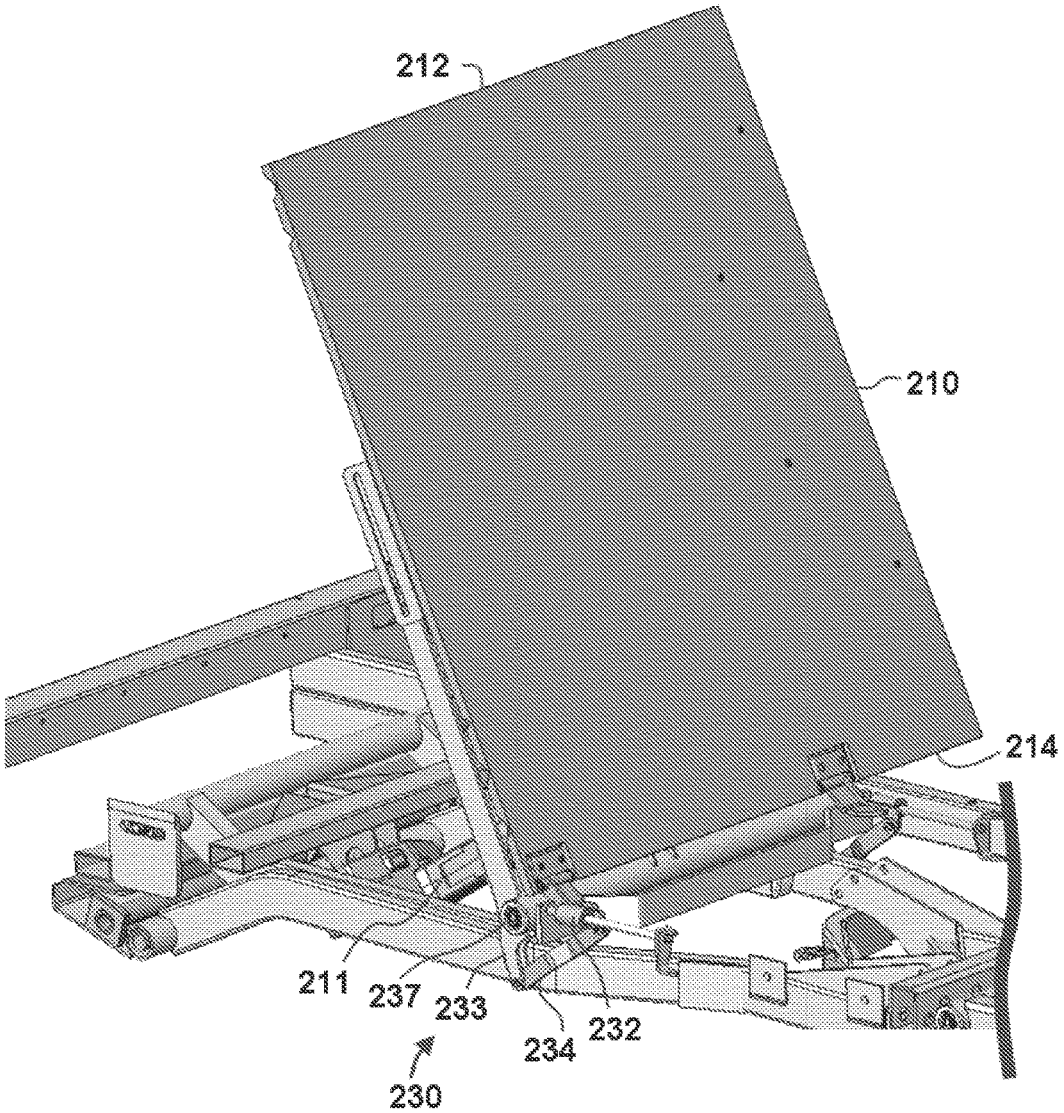
FIG. 16 depicts a perspective view of a pivoting mechanism of the patient support apparatus of FIG. 1 in a fully elevated position.

Additional features of exemplary embodiments of apparatus 100 can provide advantages to a caregiver and patient during elevation of a patient's upper torso. As shown in FIGS. 1 and 5, upper frame 200 supports patient support platform 215 comprising first portion 210 and second portion 220. In certain embodiments, first portion 210 is configured to support a patient's upper body and second portion 220 is configured to support a patient's lower body. Referring now to FIGS. 14-16, first portion 210 is coupled to a dynamic pivot mechanism 230 comprising a pivot member 237. Lower portion 220 is shown and labeled in FIGS. 1 and 5, but is not illustrated in FIGS. 14-16 for purposes of clarity so that details of dynamic pivot mechanism 230 can be seen.

In this embodiment, dynamic pivot mechanism 230 comprises a pivot member 237 and a slide member 232, Pivot member 237 is coupled to a pivot arm 233 that is pivotally coupled to a link member 234, Link member 234 is also pivotally coupled to slide member 232, thereby allowing link member 234 to pivot at each end with respect to pivot arm 233 and slide member 234.

In exemplary embodiments, upper portion 210 can be raised (e.g., inclined) with respect to lower portion 220. In specific embodiments, upper portion 210 comprises a first end 212 and a second end 214. In the embodiment shown, first end 212 is distal from second portion 220 and second end 214 is proximal to second portion 220. During operation, an actuator 211 can exert a generally upward force on upper portion 210, causing first end 212 to raise while first portion 210 (and in particular second end 214) move away from second portion 220. In the embodiment shown, second end 214 moves in a linear path away from second portion 220 while upper portion 210 and first end 212 are raised.

The ability to raise first end 212 while moving second end 214 away from second portion 220 (and away from foot end 120 of patient support apparatus 100) provides numerous benefits to a patient and a caregiver. For example, this configuration can raise a patient's upper torso without causing the patient's lower body to slide or move across second portion 220 of patient support surface 200. Such sliding movement can be harmful to a patient's skin, particularly if the integrity of the skin is compromised (e.g. from decubitus ulcers or other complications) resulting from extended periods of time on a patient support surface.

The configuration of dynamic pivot mechanism 230 can also allow a patient's upper body to be raised from, a lower and more comfortable pivot point on the patient's anatomy, including for example, the patient's hips. If upper section 210 were raised around a simple pivot point (such that second end 214 did not move away from second portion 220), the patient's upper torso could be raised in a manner that would, create stress on. other portions of the anatomy, including for example, the spine. Moving the pivot point of the patient's anatomy to an area near the hips can provide for a more ergonomic lifting of the patient's torso.

The configuration of dynamic pivot mechanism 230 can also reduce the need for a caregiver to move a patient further away from foot end 120 prior to raising the patient's upper body. For example, if upper section 210 were raised around a simple pivot point, the patient would be forced toward foot end 120. This is particularly true in cases where a thick mattress or other support surface is placed on top of patient support platform 215. Such movement could therefore require a caregiver to move a patient away from foot end 120 prior to raising the patient's upper torso.

The embodiment shown, however, provides for second end 214 of first portion 210 (e.g., the end proximal to the pivot point) to move away from foot end 120. This can accommodate the geometry of the patient support surface and the patient's anatomy to provide for a more comfortable and safer inclination, of the patient's upper torso.

The various illustrative embodiments of the present devices, apparatus, and systems are not intended to be limited to the particular forms disclosed. Rather, they include all modifications and alternatives falling within the scope of the claims. For example, embodiments other than the one shown may include some or ail of the features of the depicted embodiment.

The claims are not intended to include, and should not be interpreted to include, means-plus- or step-plus-function limitations, unless such a limitation, is explicitly recited in a given claim using the phrase(s) "means for" or "step for," respectively.

It will be understood that the benefits and advantages described above may relate to one embodiment or may relate to several embodiments. It will further be understood that reference to 'an' item refers to one or snore of those hems, unless otherwise specified. The steps of the methods described herein may be carried out hi any suitable order, or simultaneously where appropriate.

Where appropriate, aspects of any of the examples described above may be combined with aspects of any of the other examples described to form further examples having comparable or different properties and addressing the same or different problems. It will be understood that the above description of embodiments is given by way of example only and that various modifications may be made by those skilled in the art. The above specification, examples and data provide a complete description of the structure and use of exemplary embodiments. Although various embodiments have been described above with a certain degree of particularity, or with reference to one or more individual embodiments, those skilled in the art could make numerous alterations to the disclosed embodiments without departing from the scope of this invention.

The invention claimed is:

1. A patient support apparatus comprising:

a base frame;

a patient support platform supported above the base frame, wherein the patient support platform comprises a first portion and a second portion, wherein the first portion has a first end distal from the second portion and a second end proximal to the second portion, and the first portion is configured to move so that the first end of the first portion is raised while the second end of the first portion moves away from the second portion, wherein the first portion is configured to pivot around a first pivot point, and wherein the first pivot point is configured to translate in a linear path away from the second portion when the first portion is pivoted around the first pivot point; and a dynamic pivot mechanism coupled to the first portion of the patient support platform, wherein the dynamic pivot mechanism comprises a pivot member, a pivot arm coupled to the pivot member, a link member pivotally coupled at a first end thereof to the pivot arm, and a slide member pivotally coupled to a second end of the link member and extending distally of the second end of the first portion of the patient support platform towards the second portion of the patient support platform, thereby allowing the link member to pivot at each end with respect to the pivot arm and the slide member.

2. The patient support apparatus of claim 1, wherein the base frame comprises a head end and a foot end, and wherein the first portion of the patient support platform is proximal to the head end of the base frame, and wherein the second portion of the patient support platform is proximal to the foot end of the base frame.

3. The patient support apparatus of claim 1, further comprising an actuator configured to raise the first end of the first portion.

4. The patient support apparatus of claim 1, wherein the first pivot point is included in the dynamic pivot mechanism.

5. The patient support apparatus of claim 1, wherein the slide member is operatively associated with the second end of the first portion.

6. The patient support apparatus of claim 1, wherein the link member comprises a first link arm pivotally coupled to the pivot arm and a second link arm coupled to the second end of the first portion.

7. The patient support apparatus of claim 1, wherein at least a portion of the link member and a portion of the slide member are positioned between the first portion and the second portion.

8. The patient support apparatus of claim 1, wherein the pivot arm extends more than halfway along a length of the first portion.

* * * * *